US009844270B2

(12) United States Patent
Windsor

(10) Patent No.: US 9,844,270 B2
(45) **Date of Patent: *Dec. 19, 2017**

(54) RETRACTABLE SEAT ASSEMBLY

(71) Applicant: Steven T. Windsor, Spring, TX (US)

(72) Inventor: Steven T. Windsor, Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/183,592

(22) Filed: Jun. 15, 2016

(65) Prior Publication Data

US 2016/0286961 A1 Oct. 6, 2016

Related U.S. Application Data

(63) Continuation-in-part of application No. 14/707,803, filed on May 8, 2015.

(60) Provisional application No. 61/990,217, filed on May 8, 2014.

(51) Int. Cl.

| | |
|---|---|
| ***A47C 1/121*** | (2006.01) |
| ***A47C 7/00*** | (2006.01) |
| ***A47C 7/56*** | (2006.01) |
| ***A47C 9/06*** | (2006.01) |
| ***A47C 1/00*** | (2006.01) |
| ***A47C 7/14*** | (2006.01) |
| ***A47C 7/34*** | (2006.01) |

(52) U.S. Cl.

CPC ..... *A47C 1/121* (2013.01); *A47C 1/00* (2013.01); *A47C 7/002* (2013.01); *A47C 7/14* (2013.01); *A47C 7/34* (2013.01); *A47C 7/56* (2013.01); *A47C 7/566* (2013.01); *A47C 9/06* (2013.01)

(58) Field of Classification Search

CPC ..... A47C 1/121; A47C 1/00; A47C 7/002; A47C 7/14; A47C 7/34; A47C 7/56; A47C 7/566; A47C 9/06

See application file for complete search history.

(56) References Cited

U.S. PATENT DOCUMENTS

| | | | | |
|---|---|---|---|---|
| 2,636,549 | A | 4/1953 | Geller | |
| 3,594,037 | A | 7/1971 | Sherman | |
| 5,655,459 | A | 8/1997 | O'Connor | |
| 6,328,131 | B1 * | 12/2001 | Backus | A01M 31/02 182/187 |
| 6,343,834 | B1 | 2/2002 | Wurmlinger | |
| 6,557,307 | B2 * | 5/2003 | Reddig | A47C 7/40 297/162 |
| 6,896,322 | B1 | 5/2005 | Foy | |
| 6,971,711 | B1 | 12/2005 | Gast | |
| 2011/0109126 | A1 * | 5/2011 | Breit | A47C 4/20 297/16.1 |
| 2012/0098307 | A1 * | 4/2012 | Whittington | A47C 9/06 297/217.7 |

* cited by examiner

*Primary Examiner* — Philip F Gabler

(74) *Attorney, Agent, or Firm* — Bushman Werner, P.C.

(57) ABSTRACT

A retractable seat assembly which can be attached to a vertical structure and which, in the upright position, presents a profile which is relatively thin and in any event poses virtually no impediment to going very close to the vertical structure. The retractable seat assembly having a rear support, a seat, a front support, and a biaser which releasably biases said seat to the generally upright position.

13 Claims, 8 Drawing Sheets

FIG.1
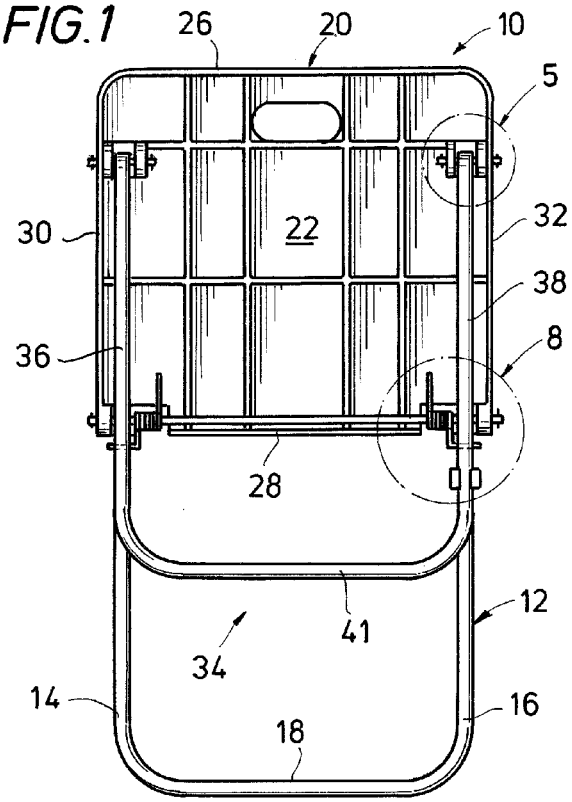
FIG.2
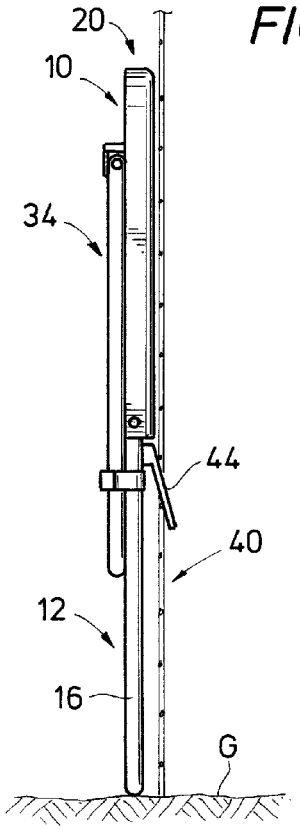
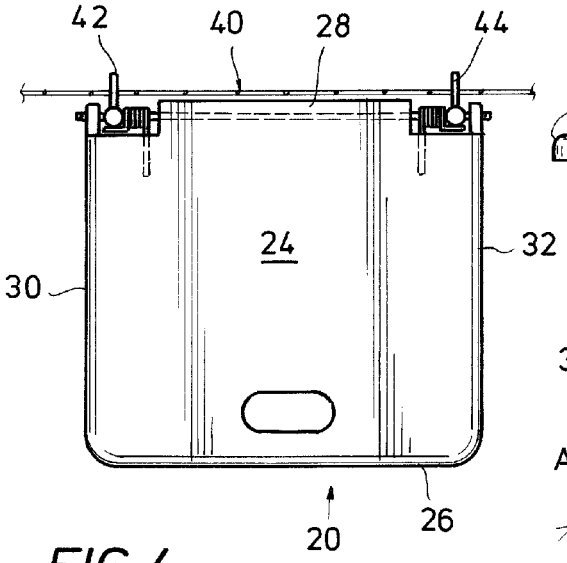
FIG.4
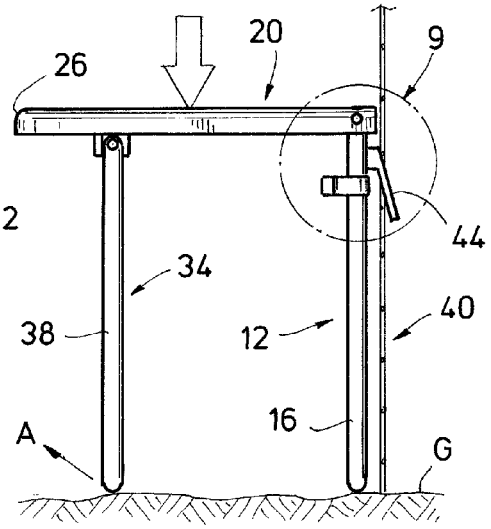
FIG.3

FIG.15
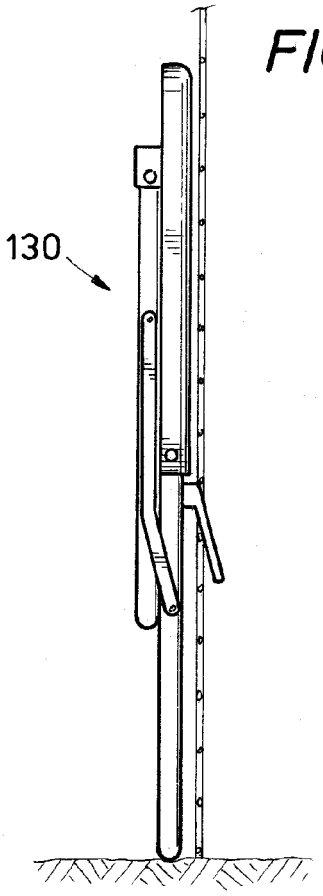
FIG.16
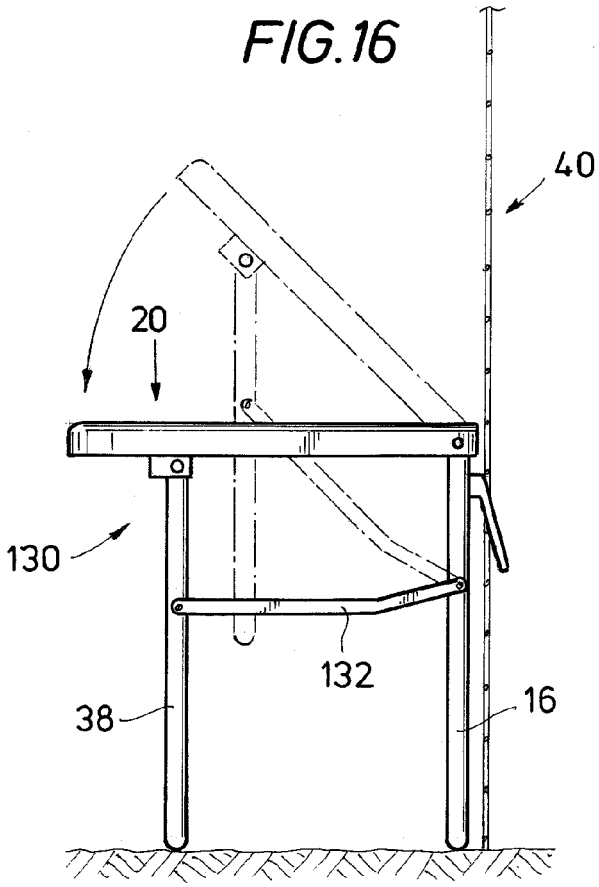
FIG.17
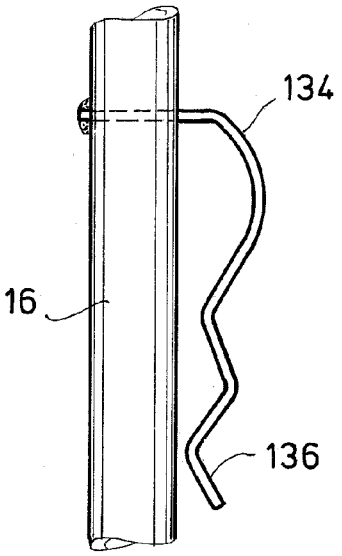
FIG.18
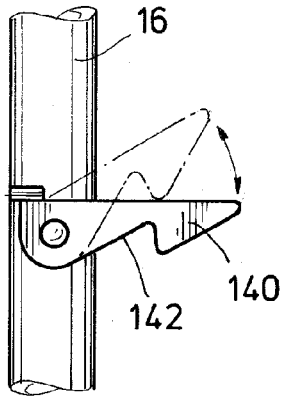
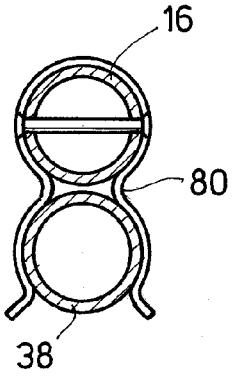
FIG.19

RETRACTABLE SEAT ASSEMBLY

CROSS REFERENCE TO RELATED APPLICATION

This application is a continuation-in-part of U.S. Ser. No. 14/707,803, filed May 8, 2015, which claims priority to U.S. Application No. 61/990,217 filed on May 8, 2014 the disclosure of which is incorporated herein by reference for all purposes.

FIELD OF THE INVENTION

The present invention relates to retractable seats and, more particularly, to retractable seats which can be fixedly or releasably attached to generally vertical structures.

BACKGROUND OF THE INVENTION

It is common for coaches and managers of baseball/softball teams, especially with teams up through the high school level to stand or "squat" next to the protective barrier between the ball field and the dugout during the game. This makes it easier for the coaches and managers to call out instructions to the team, give batting signals etc. More commonly, the managers/coaches squat outside the protective barrier as opposed to stand and, as anyone who has ever been in that position knows after several minutes it becomes quite uncomfortable as well as being hard on the knees, back etc.

Rather than squat, it has now become common place for managers/coaches to position a bucket up against the protective barrier, the bucket acting as a stool and eliminating the need for squatting. Buckets are freely used because they are common in dugouts to carry balls and, more importantly, when used in that fashion can quickly be moved. In this regard, the temporary "stool" must be quickly moved if there is a popup in foul territory and a defensive player has to get close to the dugout protective barrier to field it. Indeed, many umpires will not allow the use of buckets for the simple reason that they may not be moved quickly enough in the event of the foul ball scenario just described, and the bucket poses a tripping hazard, especially for ball players running while looking upwards to catch a ball.

SUMMARY OF THE INVENTION

In one aspect, the present invention relates to a retractable seat assembly which can be attached to a vertical structure e.g., a protective barrier for a dugout.

In another aspect, the present invention pertains to a retractable seat assembly which can be attached to a vertical structure and which, in the upright position, presents a profile which is relatively thin and in any event poses virtually no impediment to going very close to the vertical structure.

In still another aspect, the present invention relates to a retractable seat assembly which can be attached to a mesh, generally vertical structure.

In yet another aspect, the present invention pertains to a retractable seat assembly which can be adjusted in height.

In still a further aspect, the present invention relates to a retractable seat assembly for attaching to a vertical structure in which the seat portion automatically moves from a lowered position providing a seating surface to an upright position when the user of the seat in the lowered position gets up.

These and further features and advantages of the present invention will become apparent from the following detailed description, wherein reference is made to the figures in the accompanying drawings.

BRIEF DESCRIPTION OF THE DRAWINGS

FIG. 1 is a rear, elevational view of one embodiment of the retractable seat assembly of the present invention.

FIG. 2 is a side, elevational view of the retractable seat assembly shown in FIG. 1, the seat assembly being attached to a vertical structure, the seat being in an upright position.

FIG. 3 is a side, elevational view of the seat assembly shown in FIG. 2 but with the seat in the lowered position.

FIG. 4 is a top plan view of the retractable seat assembly in the position shown in FIG. 3.

FIG. 15 is a view similar to FIG. 2 showing another embodiment of the retractable seat assembly of the present invention.

FIG. 16 is a side elevational view of the retractable seat assembly shown in FIG. 15 with the seat moving from an upright to a lowered position.

FIG. 17 is an elevational view showing another type of connector for use with the retractable seat assembly of the present invention.

FIG. 18 is a side elevational view showing another type of connector for use with the retractable seat assembly of the present invention.

FIG. 19 is a view taken along the lines 19-19 of FIG. 8.

DETAILED DESCRIPTION OF PREFERRED EMBODIMENTS

Figure 5:
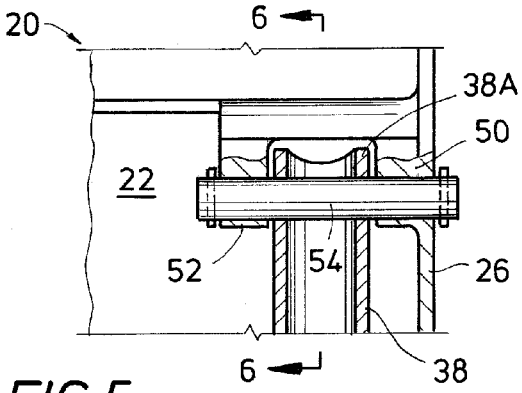
FIG. 5 is an enlarged, elevational view, partly in section, of the circled portion shown in FIG. 1.

In the description which follows, the word, "connected", "connection assembly" or variants thereof is intended to include any structure, part or assembly by which the retractable seat assembly of the present invention can be releasably and/or fixedly attached to a generally vertical structure and can include without limitation hooks, straps, springs, screws, anchor bolts etc. The term "support", "support structure" or variants thereof is intended to mean any structure, member, portion of a member or structure, leg(s), stanchion(s), frame(s) which maintains the seat position of the retractable seat assembly of the present invention in a generally horizontal disposition when the seat is in the lowered position and a downward force is applied to the seat in the lowered position. As used herein, the term "biaser", "biasing" or variants thereof is intended to include any mechanism which can maintain a first member in a first position relative to a second member, but which under the application of a suitable force can move the first member to a second position while still acting to exert a force which wants to move the first member back into the first position. Thus, a biaser can include a torsion spring, a tension extension spring, a constant force spring, elastomeric straps, or bands, etc. It will be further understood that the biaser can include a single part or an assembly of parts provided the part or assembly of parts acts in the manner described above with respect to maintaining a first member in a first position relative to a second member until a force is applied to the first member to move it to a second position but with a force still being applied to the first member in the second position tending to urge the first member back to the first position. The biasers could be one or more elastomeric or spring hinges connecting the seat to the back support. Further, an elastomeric bridge of a suitable polymeric material which was connected to the bottom side 22 of seat 20 and the leg portions of the back support 12 and which spanned an imaginary line passing through the connection portion between seat 20 and support 12 could be used. Basically any part or assembly thereof which store mechanical energy can be emphasized as a biaser, or biasing device according to the present invention.

In general, the retractable seat assembly of the present invention, described more fully hereafter, includes a back support, a front support, a seat and a connector to connect the frame to a generally vertical structure. The seat of the seat assembly is pivotally connected to both front and back supports and there is a biasing assembly operatively connected to the seat and the back support to releasably bias the seat to a generally upright position.

Referring then to FIG. 1, there is shown one embodiment of the retractable seat assembly of the present invention shown generally as 10. Retractable seat assembly 10 includes a back support shown generally as 12 comprised of a first frame which, as seen is generally U shaped having spaced apart leg portions 14, 16 connected together by a bottom cross-piece 18 at the ends of leg portions 14 and 16. The retractable seat assembly 10 further includes a seat shown generally as 20 which is pivotally connected to frame 12 as described hereafter. Seat 20 has a bottom side 22 a top side 24 (FIG. 4) a front edge 26 a back edge 28, first side edge 30 and a second side edge 32. Seat 20 may optionally have an opening or handle 15 by which a person can carry the retractable seat assembly.

Pivotally secured to the bottom side 22 of seat 20 is a front support shown generally as 34 comprised of a second frame and having a first side leg portion 36 and a second side leg portion 38, side leg portions 36 and 38 being interconnected by a cross-piece 41. The pivotal connection between front support 34 and the back side 22 of seat 20 as well as the biased, pivotal connection between seat 20 and back support 12 will be described in detail hereafter.

Referring now to FIG. 2, the seat assembly 10 is shown with the seat 20 in an upright position and legs portion 16, 18 of back support 12 connected to a chain link fence 40. As is well known a chain link fence is comprised of a heavy steel wire woven to form a diamond shaped mesh. As can be seen with reference to FIGS. 2 and 4, there are a pair of hooks 42 and 44 which connected to leg portions 18, 16 respectively of back support 12. Hooks 44, 42 extend outward from leg portions 16, 18 respectively at a slight angle. Thus a user can place frame 12 against chain link fence 40 at a position such that cross-piece 18 or support 12 is slightly above a resting surface e.g., ground G, such that with the hooks 42, 44 extending through the diamond shaped openings in the chain link fence 40, when the retractable seat assembly 10 is moved downwardly two of the wires of fence 40 will be trapped in the space between the hooks 42, 44 and the leg portions 18, 16, respectively. In effect the engaged wires of fence 40 will be wedged between the hooks 42, 44 and the legs 16, 18 respectively. At this juncture even if cross-piece 18 were slightly above ground G, once the seat 20 of retractable seat assembly 10 is moved from its upright position to its lowered position as shown in FIG. 3, and the user sat on the front surface 24 of seat 20, cross-piece 18 of frame 12 would engage the ground G. As well, frame 34 will swing outwardly to the position shown in FIG. 3 such that cross-piece 41 also engaged the ground G thereby providing a firmly supported seating surface, much in the form of a stool, on which a user could sit.

Thus, the lower most portion of support 12 and the lower most portion of support 34 effectively provide "legs" which engage the ground G or other surface to support the seat 20 in the position shown in FIG. 3.

As will be seen hereafter, hooks 42 and 44 are just one type of connector which can be used with the retractable seat 10 of the present invention. Preferably, whatever type of connector is used will allow the user to quickly and easily connect the retractable seat assembly 10 to the vertical structure e.g., chain link fence 40, will hold the back support 12 close to the chain link fence 40 or other vertical structure, and will allow the seat assembly to be quickly and easily removed from chain link fence 40 when the seat assembly 10 is no longer in use. Although two hooks, 42 and 44 are shown, it will be appreciated that frame 12 can be provided with an upper cross-piece close to the connection point between seat 20 and frame 12, and one or more additional hooks attached to that cross-piece and would engage fence 40 as described above.

It will be understood that a chain link fence such as chain link fence 40 is a flexible structure, the woven mesh being supported by fence poles (not shown) spaced at desired distances from one another, the mesh portion of the chain link fence 40 being connected to the poles to maintain the mesh in a generally vertical position. None the less, should the poles be spaced at large distances from one another as is often the case, and if the seat assembly 10 were placed mid way between such spaced apart poles, there could be sufficient give or resiliency in the mesh of the chain link fence such that placement of the retractable seat assembly 10 as described above might tend to bow the mesh portion of the fence slightly outwardly toward retractable seat assembly 10. Accordingly, to the extent practical, it would be desirable for the user to position the seat assembly 10 closer to a fence support pole where the mesh portion of the fence has less flexibility. It is to be understood however that even if the retractable seat assembly 10 were placed in an intermediate position on the mesh portion of the fence where the fence had substantial give, retractable seat assembly 10 would still function to provide a temporary, removable seating surface for a user.

As can be seen from the description of the retractable chair assembly of the present invention in conjunction with FIGS. 1-4, the retractable seat assembly when not in use i.e., no downward force is applied to surface 24 while seat 20 is in the lowered position, it will not pose an obstacle to someone wanting to get near to chain link fence 40. When in use, as shown in FIGS. 3 and 4, seat 20 projects outwardly away from chain link fence 40 and if it remained in that position, would pose an obstacle to someone wanting to closely approach chain link fence 40.

One of the goals of the retractable seat assembly of the present invention is that, while not in use but still connected to a vertical structure such as chain link fence 40, it forms little to no obstruction in front of the chain link fence. Additionally, it is desirable that when it is in use as shown in FIGS. 3 and 4, and if the user desires to quickly move off the seating surface 24 of seat 20, the seat 20 and front support provided 34 will move into the upright position shown in FIG. 2. To this end, a biaser or biasing assembly interconnects seat 20 to back support 12 such that the seat 20 is normally biased in the upright position e.g., in a position shown in FIG. 2. To this end reference is now made to FIGS. 5-9 to describe in detail one method of pivotally connecting both supports 12 and 34 to seat 20 as well as one assembly for biasing seat 20 in the upright position shown in FIG. 2.

Figure 6:
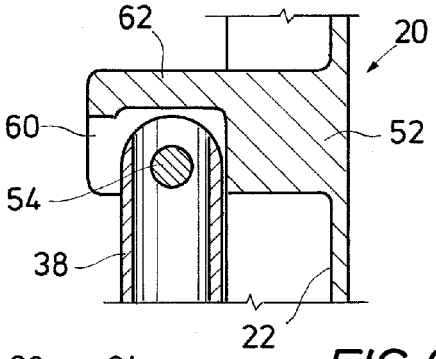
FIG. 6 is a cross sectional view taken along the lines at 6-6 of FIG. 5.
Figure 7:
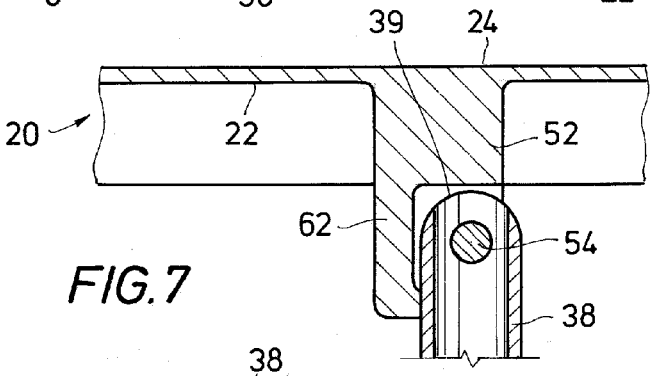
FIG. 7 is a view similar to FIG. 6 but showing the seat moved in the lowered position.
Figure 8:
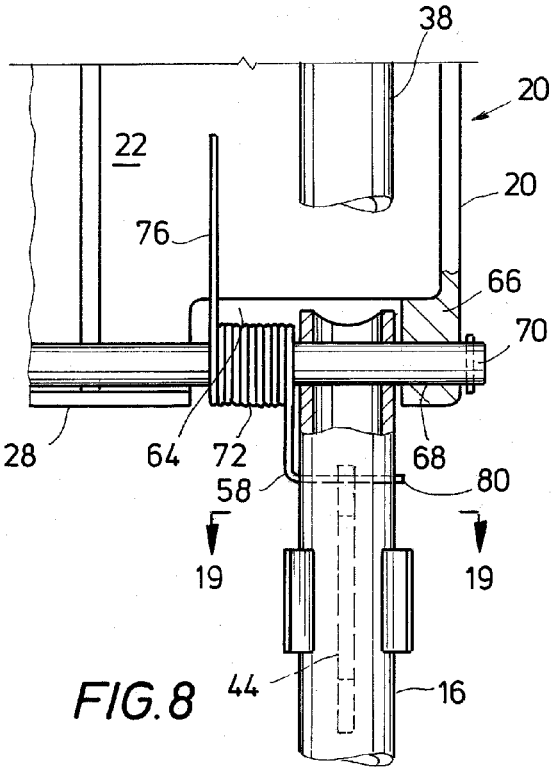
FIG. 8 is an elevational view, partly in section of the circled area shown in FIG. 1.
Figure 9:
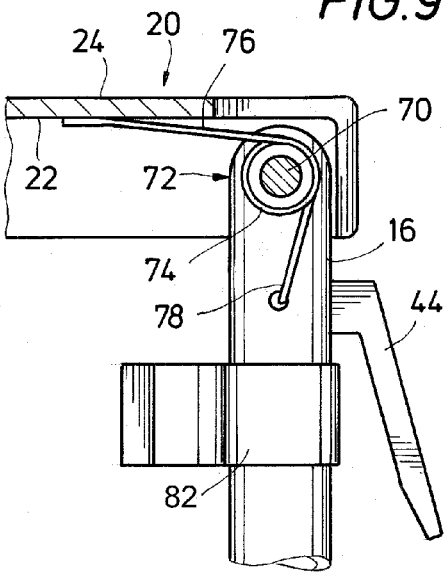
FIG. 9 is an elevational view, partly in section of the circled area shown in FIG. 3.

FIGS. 5-7 show the details of one technique of connecting frame 34 to seat 20 while FIGS. 8 and 9 show the details of one technique of both connecting seat 20 to frame 12 as well as biasing seat 20 to the upright position shown in FIG. 2. Referring then first to FIGS. 5-7, formed, either integrally with or attached by a suitable method, to the bottom side 22 of seat 20 are pillow blocks 50 and 52 which serve to journal a pin or shaft 54, shaft 54 extending through registering holes in tubular leg portion 38 of support 34. As can be seen, shaft 54 is maintained in place by snap rings 56, 58 on opposite ends of shaft 54. As will be understood, a like pivotal connection is used between seat 20 and leg portion 36.

Referring now to FIG. 6, the connection between seat 20 and support 34 is further shown. In the position shown in FIG. 6, seat 20 is in the upright position as depicted in FIG. 5. As can be seen, pillow block 52 which is attached, as noted above, to the bottom side 22 of seat 20 has a recess 60 which provides a space allowing upper end 39 of leg portion 38 of support 34 to pivot. In order to keep leg portion 38 and front support 34 from continuing too far out away from support 12, pillow block 52 forms a stop 62, which as seen with reference to FIG. 7 stops the motion of leg portions 36, 38 from further movement in the direction of arrow A (FIG. 3) when seat 20 is moved down to its lowered position for seating. This prevents support 34 from splaying outwardly to far such that when seat 20 was in the down position and a user sat on seating surface 24, the seat assembly 10 might collapse.

Turning now to FIGS. 8 and 9, there is shown in greater detail one technique of how support 12 is pivotally interconnected to seat 20 in such a fashion that seat 20 is normally biased in an upright position. Referring then to FIG. 8, the rear edge 28 of seat 20 has cutouts 64 (only one of which is shown) at least partially defined by an ear 66 forming part of seat 20. Ear 66 has a bore 68 extending there through. Received through bore 68 is a shaft 70 on which is mounted a torsion spring shown generally as 72 having a coil portion 74 a first leg 76 and a second leg 78. In the position shown in FIG. 8, spring 72 is in the relaxed position. Thus, as can be seen leg 76 of spring 72 engages the backside 22 of seat 20 while leg portion 78 of spring 72 is L shaped, having a first run 79, and a second run 80 extending through registering holes in leg 16 of support 12.

Referring now to FIG. 9, there is shown seat 20 in the lowered position for use. As will be understood, with the seat 20 in its lowered position for use, the helical coiled portion 74 of spring 72 has now undergone twisting such that the legs 76 and 78 are applying torque both to leg 16 and to the bottom surface 22 of seat 20. Since leg 78 is not free to move, run 80 thereof being trapped in registering holes in leg 16, the stored energy in the helical portion 74 of spring 72 is transmitted to leg 76 which urges or biases seat 20 in the upright position i.e., in the position shown in FIG. 8. Accordingly, once any weight or force acting to keep seat 20 in the position shown in FIG. 9 is removed, i.e., if a person sitting on seating surface 24 of seat 20 gets up, the stored energy in spring 72 will automatically force (via leg 76), seat 20 to the upright position shown in FIG. 8.

FIGS. 8, 9 and 19 also show the use of a spring clip whereby when the retractable seat assembly 10 of the present invention is in a collapsed or upright position e.g., as shown in FIG. 1, the open, U-shaped portion of spring clip 82 will receive leg 16 of frame 12 and releasably hold it in that position.

It will be understood while only one connection between seat 20 and front support 34 has been shown and only one connection between seat 20 and back support 12 has been shown, it will be understood, as can be seen from FIG. 1, that there are two pivotal connections between front support 34 and seat 20 and two biased, pivotal connections between seat 20 and back support 12.

Figure 10:
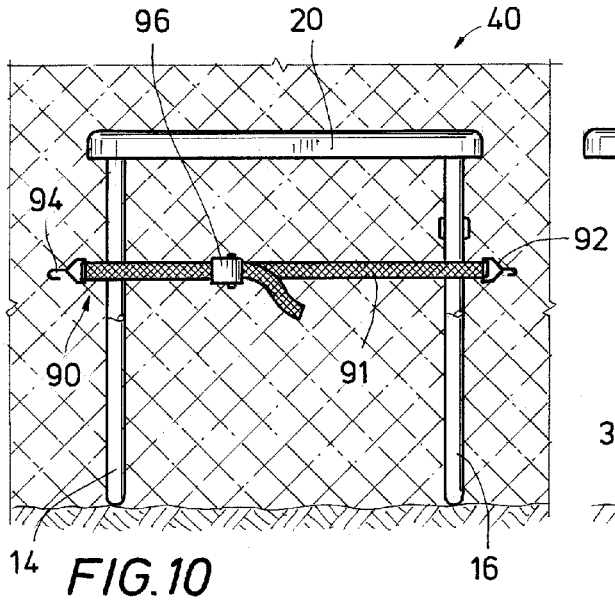
FIG. 10 is an elevational view of another embodiment of the present invention, showing another method of connecting the seat assembly to a vertical structure e.g., a chain link fence.
Figure 11:
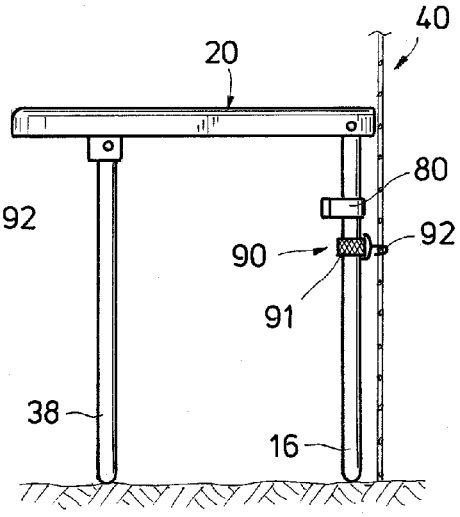
FIG. 11 is a side, elevational view of the retractable seat shown in FIG. 10.

Referring now to FIGS. 10 and 11 there is shown another connection assembly for attaching the retractable seat assembly 10 of the present invention to a vertical structure e.g., chain link fence 40. In the embodiments shown in FIGS. 10 and 11, an adjustable strap shown generally as 90 supplied with hooks 92 and 94 at opposite ends is wrapped over legs 16 and 14 of back support 12, hooks 92 and 94 engaging metal strands of the chain link fence 40. Strap 90 can also include an adjustable buckle 96 which can be used to adjust the length of strap 91 between hooks 92 and 94 thereby forcing the back support 12 snugly against the mesh of fence 40.

Figure 12:
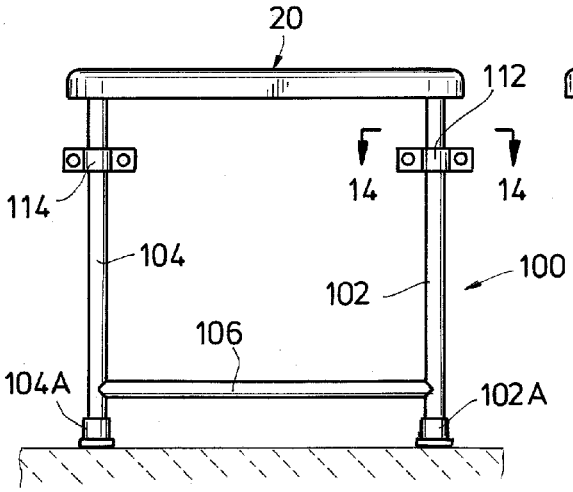
FIG. 12 is a front elevational view of another embodiment of the seat assembly of the present invention attached to a rigid structure e.g., a wall.
Figure 13:
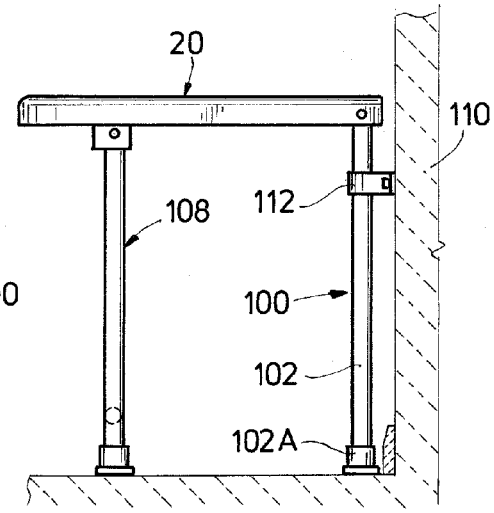
FIG. 13 is a side, elevational view of the seat assembly shown in FIG. 12.
Figure 14:
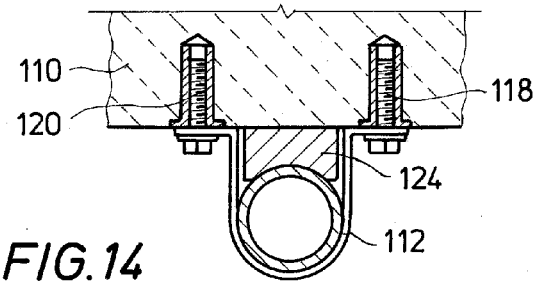
FIG. 14 is a view taken along the lines 14-14 of FIG. 12.

FIGS. 12-14 show a technique for connecting the retractable seat assembly of the present invention to a vertical, rigid support such as a wall. As shown in FIG. 12, the back and front supports differ from those shown in FIGS. 1-11 in that rather than comprising a frame having a U-shape, they are H-shaped. Thus, rear support 100 has legs 102 and 104 terminating in feet 102A and 104A respectively, legs 102 and 104 being interconnected by cross brace 106. It will be understood that front support 108 has a similar construction as that described with respect to rear support 100.

To connect the retractable seat assembly of FIGS. 12 and 13 to wall 110, a pair of brackets 112 and 114 are placed around legs 102 and 114, respectively, and secured to wall 110 by anchor bolts or the like, depending upon the material of construction of wall 110. For example if wall 110 were wood, simple screws could be employed. As seen in FIG. 114, there are standoffs 124 between leg 112 and wall 110 to allow seat 120 to pivot to the upright position under the force of the biasing element e.g., spring 72 when the user gets off the seat 20.

Turning now to FIGS. 15 and 16, there is shown a slightly different embodiment of the retractable seat assembly of the present invention. Retractable seat assembly 130 is, in all respects, substantially the same as that shown in FIG. 1 with the exception that there are pivoting arms 132 (only one of which is shown) interconnected between legs 16 and 38 of back and front supports 12 and 34, respectively. The pivoting arms 132 ensure that when the seat 20 is moved in the lowered position, shown in the dotted position in FIG. 16, the front support 34 will be formed into the position shown in FIG. 15. It will be understood however that the pivoting arms 132 are optional since once seat 120 is moved to the lowered position, there is sufficient momentum to cause the front support 34 to move the position shown in FIG. 16. If desired front support 34 could be weighted at its lower end to aid in swinging support 34 outwardly.

FIG. 17 shows another connector that can be used with the retractable seat assembly of the present invention. In the embodiment shown in FIG. 17, the connector comprises a hook 134 which is secured to leg 16 (and also to leg 14 of rear support 12 as would be understood by those known in the art). Unlike hooks 44 and 42 shown in FIG. 4, which tend to form a tapering recess between hooks 42, 44 and the respective frame legs to which they are attached, hook 134, as can be seen, simply forms a larger space between leg 16 and hook 134 at the point where hook 134 is adjoined to leg 16. In this regard, hooks 42 and 44 are preferred because of the V-shaped recess formed between those hooks and the legs of the back support which insure the metal wire of the chain link fence 40 is wedged in the V-shaped recess.

With respect to FIG. 17 and hook 134, it should be noted that the lower ends of the hooks 134 have a flared out portion 136 which more easily allows the hooks 134 to be placed over a wire of the chain link fence 40. It will also be understood that such a flared out portion could be added to hooks 42, 44 for the same reason.

With respect to FIG. 18, there is shown another connector in the form of a pivoting hook 140 which has a notch 142. Using the connector shown in FIG. 18 with the retractable seat assembly of the present invention, when the rear support of the retractable chair assembly was placed against a fence or the like, hook 40 would move to the dotted position shown in FIG. 18. Thus with a chain link fence 40 as the vertical structure as the retractable seat assembly was moved down, the pivoting hooks 140 would eventually engage wires of the chain link fence and nest in the notch 142.

It will be understood with respect to all of the descriptions given above, that while with respect both to the rear support and the front support, in many cases only one interconnection between seat 20 and the rear support e.g., support 12, or in the case of the interconnection between the front support 34 and the seat 20 has been described, it will be understood that there would generally be two such connections usually on opposite sides of the seat.

Figure 20:
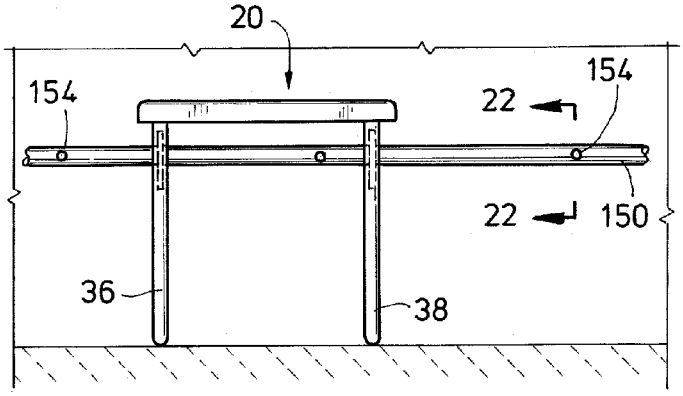
FIG. 20 is a front, elevational view of another embodiment of the retractable seat assembly of the present invention connected to a wall structure.

Referring now to FIGS. 20-25 there are shown other connectors and connector assemblies for attaching the retractable seat assembly of the present invention to a rigid structure e.g., a wall or the like. Referring first to FIG. 20, there is an elongated bar, rod or the like 150 which is attached to a rigid wall surface 152 by means of anchor bolts 154 which extend through rod 150 and a tubular standoff 156 which is secured e.g., by welding to rod 150. Standoffs 156 are in turn secured to a plate 158 having a hole 160 therethrough for passage of anchor bolt 154. As can be seen, the attachment assemblies comprised of plates 158, standoffs 156 and anchor bolts 154 are spaced at longitudinal intervals along the length of rod 150. As can be seen, the standoffs 156 provide a space between wall surface 152 and rod 150 to allow pivot space for seat 20 when it moves to the upright position. Attached to rear support 12 on both leg portions thereof are L-shaped hooks 162. Thus, the retractable seat assembly of the present invention in the embodiments shown in FIGS. 23-25 can be attached to a rigid vertical structure e.g., a wall simply by placing hooks 162 over bar 150 such that the downwardly extending leg portion of hook 162 fits into the space between rod 160 and wall surface 152. It would also be appreciated that with the arrangement shown in FIGS. 20-25, a plurality of retractable chair assemblies can be positioned against the wall surface 152.

Figure 23:
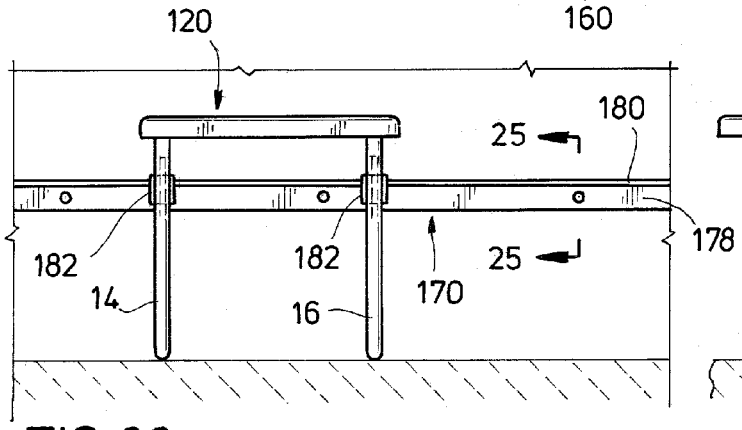
FIG. 23 is a view similar to FIG. 20 but showing another connector assembly for releasably attaching the seat assembly to a rigid structure e.g., a wall.
Figure 24:
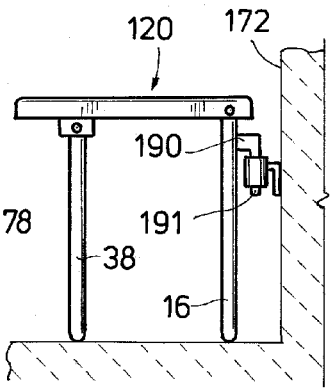
FIG. 24 is a side, elevational view of the embodiment shown in FIG. 23
Figure 25:
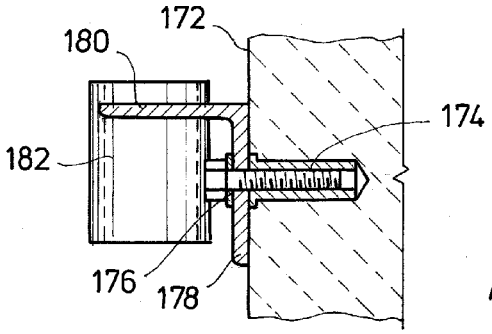
FIG. 25 is a detailed, side elevational view of the connection assembly used with the embodiment shown in FIG. 23.

Referring now to FIGS. 23-25 there is shown another embodiment of a connection assembly for attaching the retractable seat assemblies of the present invention to a rigid wall. An angle iron 170 is secured to a wall surface 172 using anchor bolts 174 and the like. As can be seen, the anchor bolts 174 extend through one leg 178 of angle iron 170 which has a hole 176 therein through which anchor bolt 174 can pass. Attached to the other leg 180 of angle iron 170 are at least one pair of socket forming structures 182 which can, for example, be short segments of pipe and which are spaced apart from one another a distance equal to that between the hooks 190 attached to leg portions 14 and 16 of back support 12. Accordingly, to attach the retractable seat assembly using the arrangement shown in FIGS. 23-25, hooks 190 have a downwardly projecting leg portion (a) which fits into the sockets 182.

Figure 21:
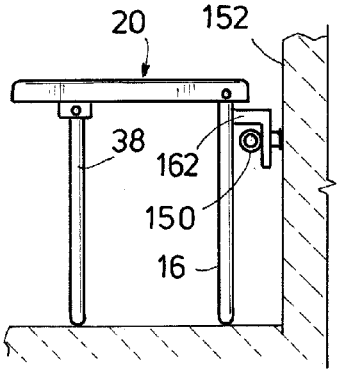
FIG. 21 is a side, elevational view of the seat assembly shown in FIG. 20.
Figure 22:
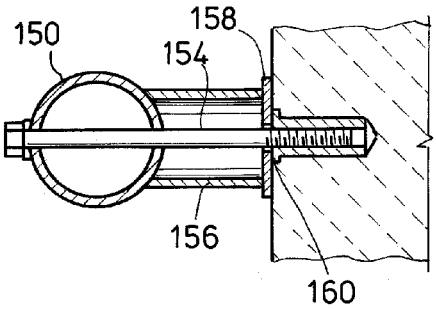
FIG. 22 is a detailed side elevational view, partly in section of a connector for use with the retractable seat assembly of the present invention.

The arrangement shown in FIGS. 23-25 is less flexible than that shown in FIGS. 20-22 in the sense that the sockets 182 have to be spaced the correct distance for receipt of the hooks 190. In this regard and as discussed above with the arrangement shown in FIGS. 20-22, the retractable seat assemblies can be placed at virtually any location along the length of tube, bar or rod 150.

Figures 26, 27, 28:
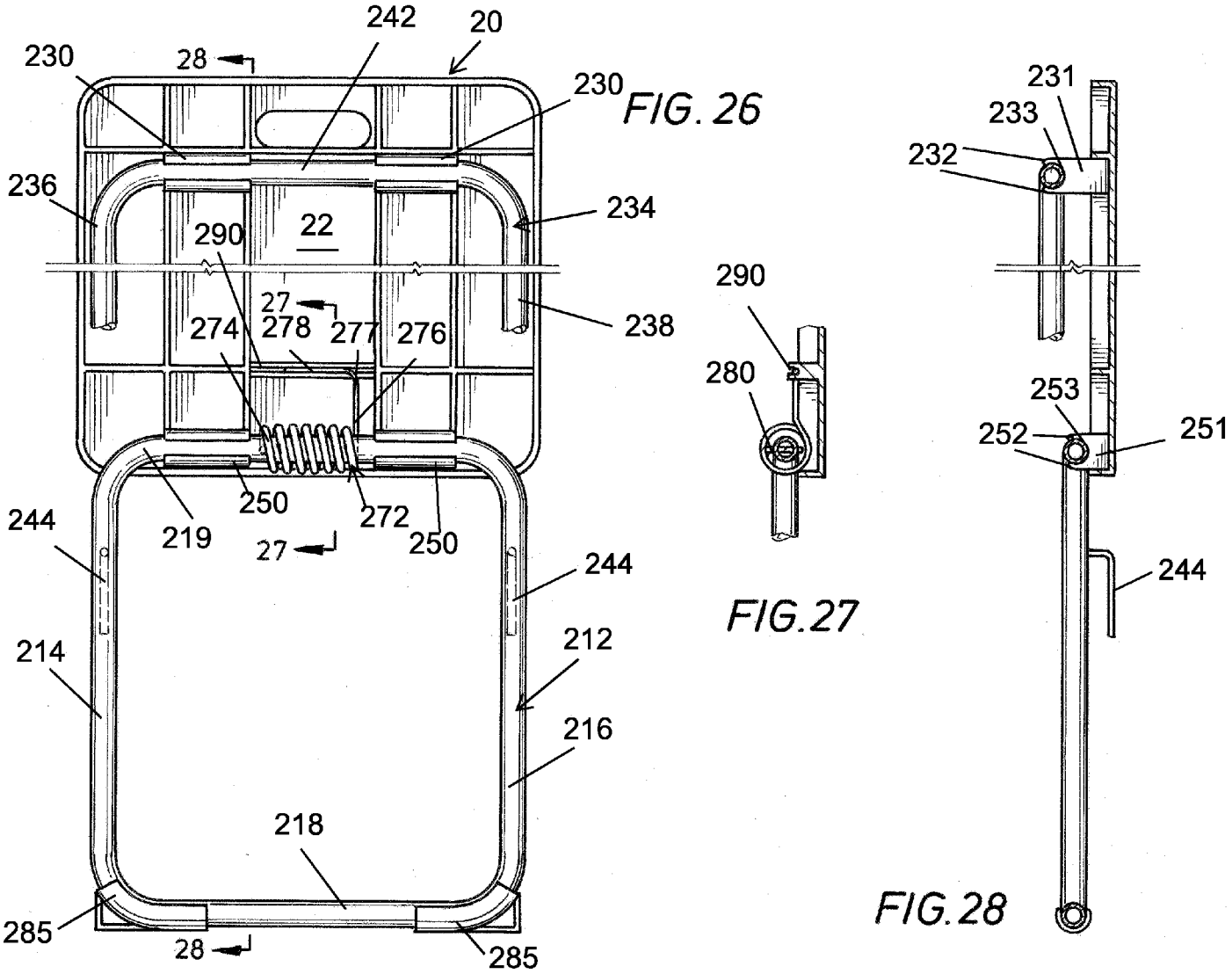
FIG. 26 is a rear, elevational view of another embodiment of the retractable seat assembly of the present invention.
FIG. 27 is a cross-sectional view taken along the lines 27-27 of FIG. 26.
FIG. 28 is a cross-sectional view taken along the lines 28-28 of FIG. 26.

Turning now to FIGS. 26-28, there is shown an embodiment of the retractable seat assembly similar to that depicted in FIG. 1. Retractable seat 20 is pivotally connected to a back support shown generally as 212 comprised of a first frame which, as seen is generally rectangular shaped, having spaced apart leg portions 214, 216 connected together by a bottom cross-piece 218 and a top cross-piece 219 at the respective ends of leg portions 214 and 216.

Pivotally secured to the bottom side 22 of seat 20 is a front support shown generally as 234 comprised of a second frame and having a first side leg portion 236 and a second side leg portion 238, side leg portions 236 and 238 being interconnected by a top cross-piece 242 and a bottom cross-piece not shown. Supports 212 and 234 may optionally have pads or cushions 285 proximal the ground. A pair of L-shaped hooks 244 extend from support 212.

The bottom side 22 of seat 20 has at least one, preferably two, clips 230 proximal front edge 26 and at least one, preferably two, clips 250 proximal rear edge 28. Clips 230 are comprised of base blocks 231 which cooperate with first and second arms 232 which form a generally circular channel 233 in which top cross-piece 242 of support 234 is journaled. Similar to clips 230, clips 250 are comprised of base blocks 251 which cooperate with first and second arms 252 to form a generally circular channel 253 in which top cross-piece 219 of support 212 is journaled. It will be understood that clips 230 and 250 are made of plastic or any other material which provides sufficient give to allow cross-pieces 242 and 219 to be snapped into respective channels 233 and 253. Mounted on top cross-piece 219 is a torsion spring shown generally as 272 having a coil portion 274, a first leg 276 and a second leg 280 (FIG. 27). In the position shown in FIG. 26, spring 272 is in the relaxed position. As can be seen leg 276 of spring 272 is L-shaped, having a first run 277 and a second run 278. Bottom side 22 of seat 20 has an elongate notch or slot 290 in which second run 278 of spring 272 is frictionally nested. Leg 276 of spring 272 engages the bottom side 22 of seat 20 while leg 280 of spring 272 extends through a hole in cross-piece 219 of support 212.

It will be understood that the embodiment of FIGS. 26-28 operates in a manner similar to that of the embodiment in FIG. 1. Namely, as shown in FIG. 26, the spring 272 is in the relaxed position. Were someone to pivot seat 20 downwardly, as to sit on it for example, support 234 would swing outwardly to engage the ground and provide a firmly supported seating surface. Additionally, during the pivoting, spring 272 would undergo twisting. Since leg 280 of spring 272 is not free to move, the stored energy in the helical portion 274 of spring 272 is transmitted to leg 276 which urges or biases seat 20 in the upright position. Accordingly, when the weight or force acting on seat 20 is removed, i.e., the seated person stands up, the stored energy in spring 272 will force seat 20 to the upright position shown in FIG. 26.

As can be seen from the above, the retractable seat assembly of the present invention provides a versatile apparatus to provide a temporary seating surface for a user. The retractable seat assembly can be attached to virtually any upright e.g., generally vertical structure, be it a chain link fence, a post or a wall. For example, with respect to a post, an adjustable strap assembly such as that shown in FIGS. 10 and 11 can be employed. If desired, the retractable seat assembly can also be permanently secured to a vertical structure e.g., a wall such as wall 110 by the connector assembly shown in FIGS. 12-14.

Figure 30:
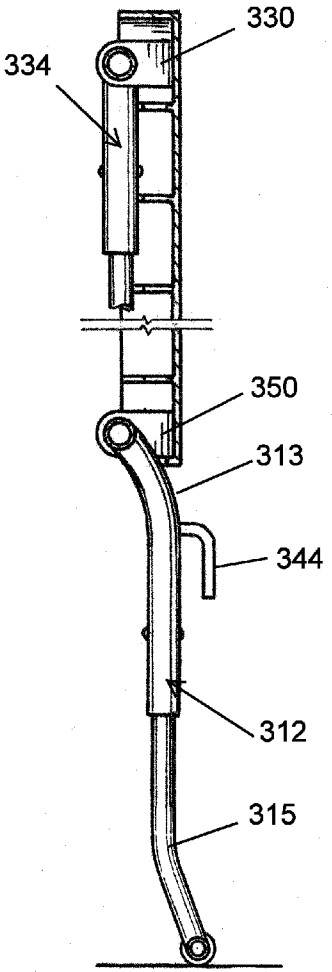
FIG. 30 is a cross-sectional view taken along the lines 30-30 of FIG. 29.
Figure 29:
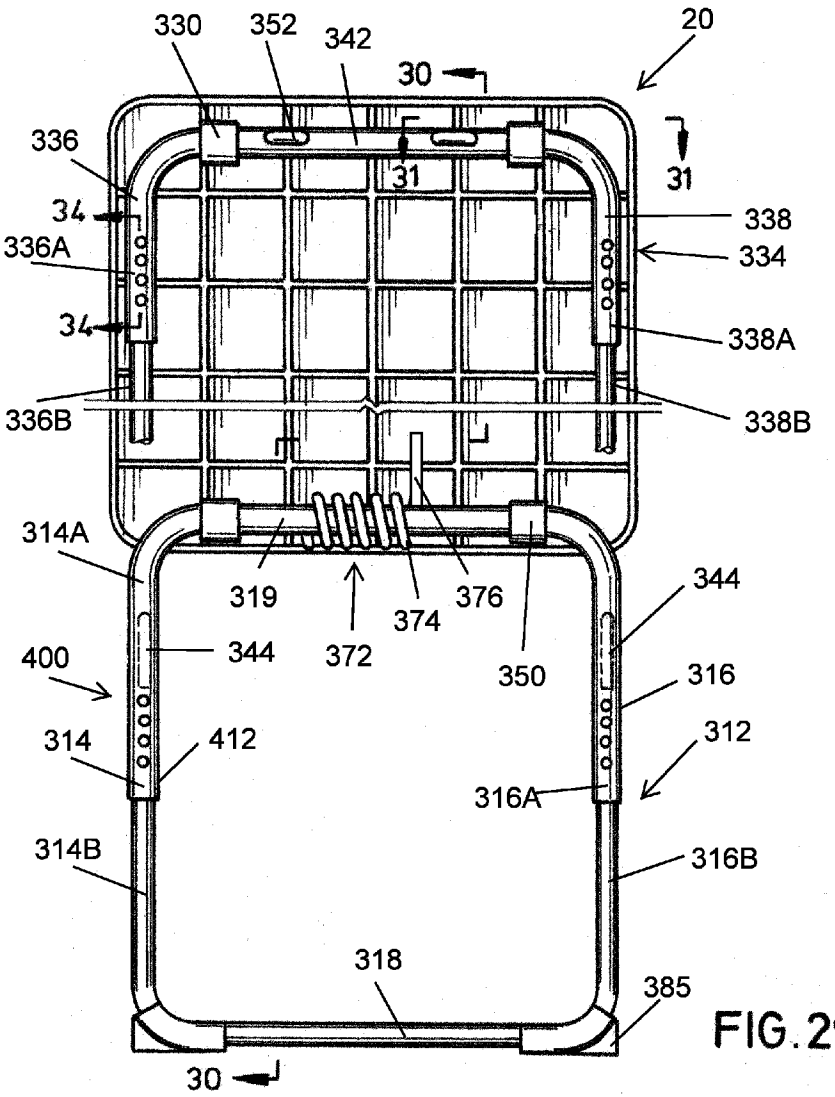
FIG. 29 is a rear, elevational view of another embodiment of the retractable seat assembly of the present invention.

Turning now to FIGS. 29-30, there is shown an embodiment of the retractable seat assembly similar to that depicted in FIGS. 26-28. Retractable seat 20 is pivotally connected to a back support shown generally as 312 comprised of a first frame which, as seen is generally rectangular shaped, having spaced apart leg portions 314, 316 connected together by a bottom cross-piece 318 and a top cross-piece 319 at the respective ends of leg portions 314 and 316. A pair of L-shaped hooks 344 extend from leg portions 314 and 316.

Pivotally secured to the bottom side 22 of seat 20 is a front support shown generally as 334 comprised of a second frame and having a first side leg portion 336 and a second side leg portion 338, side leg portions 336 and 338 being interconnected by a top cross-piece 342 and a bottom cross-piece not shown. Supports 312 and 334 may optionally have pads or cushions 285 proximal the ground.

Top cross-pieces 342 and 319 are rotatably journaled in a plurality of pillow blocks 330 and 350, respectively, which are attached to seat 20.

Mounted on top cross-piece 319 is a torsion spring shown generally as 372 having a coil portion 374, a first leg 376 and a second leg (not shown) similar to that shown in FIGS. 26 and 27. In the position shown in FIG. 29, spring 372 is in the relaxed position. Leg 376 of spring 372 engages the bottom side 22 of seat 20 while the second leg of spring 372 extends through a hole in cross-piece 319 of support 312.

It will be understood that the embodiment of FIGS. 29-30 operates in a manner similar to that of the embodiment in FIG. 27-28. Namely, as shown in FIG. 29, the spring 372 is in the relaxed position. Were someone to pivot seat 20 downwardly, as to sit on it for example, support 334 would swing outwardly to engage the ground and provide a firmly supported seating surface. Additionally, during the pivoting, spring 372 would undergo twisting. The stored energy in the helical portion 374 of spring 372 is transmitted to leg 376 which urges or biases seat 20 in the upright position. Accordingly, when the weight or force acting on seat 20 is removed, i.e., the seated person stands up, the stored energy in spring 372 will force seat 20 to the upright position shown in FIG. 29. The embodiment of FIGS. 29-30 include a height adjust assembly shown generally as 400 which will be explained more fully hereafter.

In a preferred embodiment, and as best seen in FIG. 30, support 312 will have a bend 313 near seat 20 in a direction toward the front of the seat, i.e., away from hooks 344. Bend 313 is preferably proximal seat 20 and operates to provide space for seat 20 to rotate. Specifically, the bend 313 allows rotation of the seat 20 without scraping, marring, or getting hung up on the wall, fence, or other vertical surface against which it is placed. The lower portion of support 312 has a bend 315 in a direction toward the back of the seat, i.e., toward the hooks 344. The lower bend 315 offsets the upper bend 313 and braces against the wall, fence, or other surface. Without lower bend 315, when the seat 20 is lowered, the lower part of support 312 would be pushed back toward the support, causing the seat 20 to tilt downwards. It will be appreciated that the seat of the present invention may utilize only an upper bend, or only a lower bend, and still be within the scope of the invention. The embodiment depicted in FIG. 30 is the preferred embodiment, using both upper and lower bends. It will further be appreciated, that the term "bend" as used herein can include angles, curves, and other changes in direction, whether they are sharp or rounded.

Figure 31:
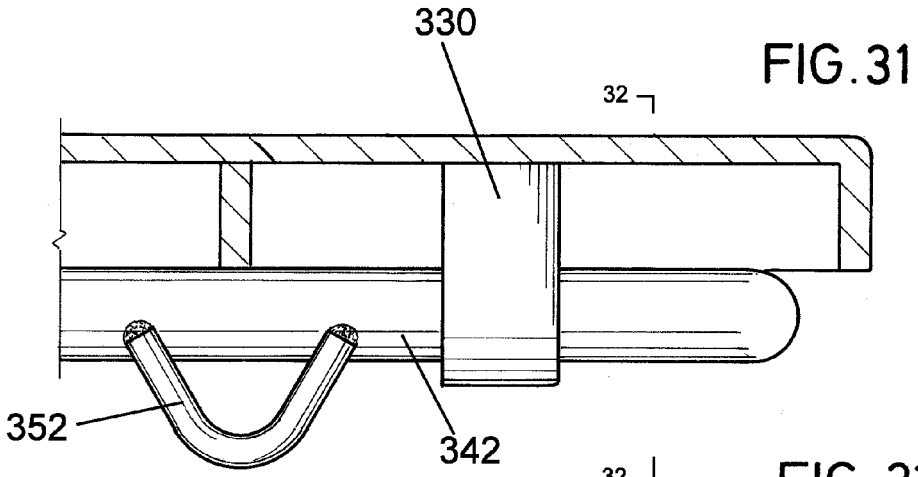
FIG. 31 is a cross-sectional view taken along the lines 31-31 of FIG. 29.
Figure 32:
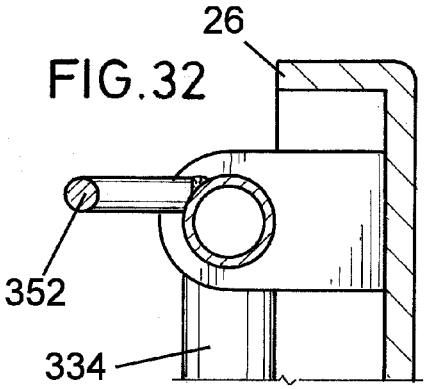
FIG. 32 is a cross-sectional view taken along the lines 32-32 of FIG. 31.
Figure 33:
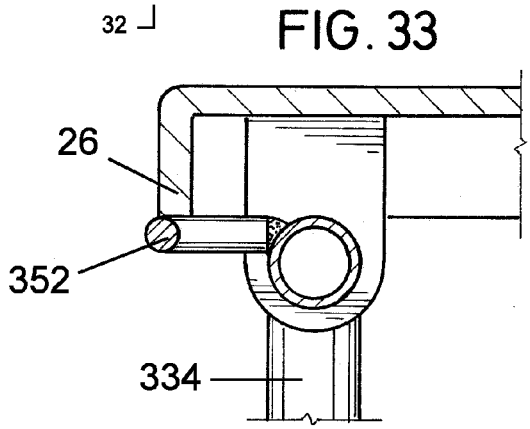
FIG. 33 is a view similar to FIG. 32 but showing the seat in the lowered position.

Turning to FIGS. 31-33, there is shown a stop 352 which prevents front support 334 from swinging too far forward away from support 312. FIG. 32 shows stop 352 when seat 20 in its raised position. When seat 20 is moved to its lowered position, stop 352 engages front edge 26 and prevents front support 334 from moving further. Thus, front support 334 cannot go beyond a certain point and prevents collapse of the seat due to overextension of the front legs. As shown in FIGS. 31-33, stops 352 are V-shaped and attached by welding. It will be appreciated that any shape and any means of attachment are within the scope of this invention.

Figure 34:
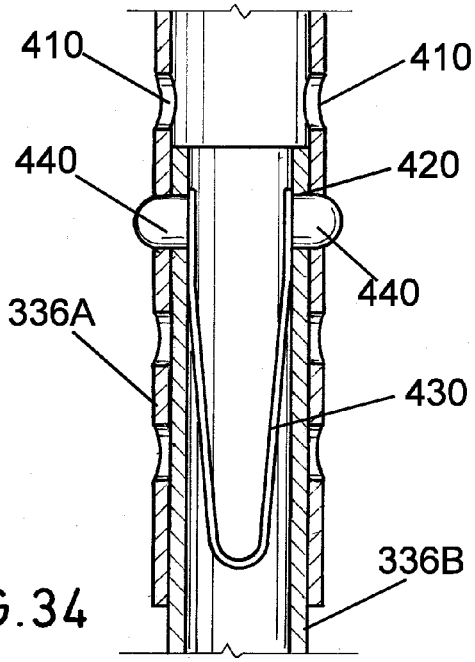
FIG. 34 is a cross-sectional view taken along the lines 34-34 of FIG. 29.
Figure 35:
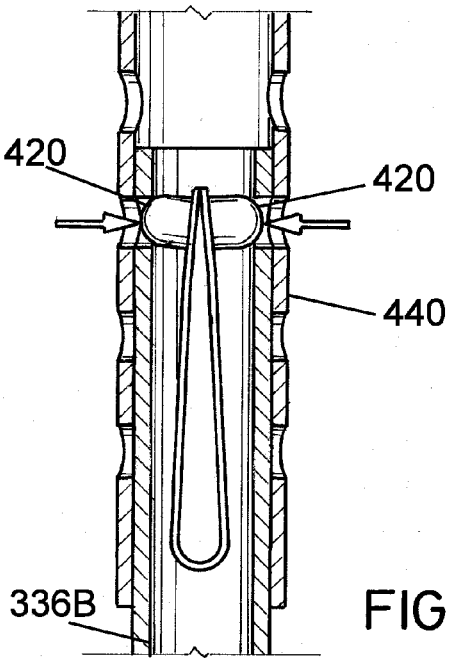
FIG. 35 is a view similar to that of FIG. 34 but showing the buttons pressed inward.

FIGS. 34-35 show the operation of height adjustment assembly 400. As seen in FIG. 29, the height adjustment assemblies can be present on side leg portions 314, 316, 336, and 338. FIG. 34 represents the height adjustment assembly of side leg portion 336. It will be appreciated that the height adjustment assembly is identical in the other side leg portions and thus will only be described in detail once.

Height adjustment assembly 400 generally comprises a detent assembly. As best seen in FIG. 29, side leg portion 336 is comprised of outer leg 336A and inner leg 336B. Outer leg 336A has a plurality of axially spaced registering bores 410 along a portion of its length. Inner leg 336B has a single pair of registering bores 420 extending through it. Disposed within inner leg 336B is biasing clip 430. Biasing clip 430 is generally V-shaped and includes a pair of buttons 440 on one end. Biasing clip 430 forces buttons 440 outwardly away from one another. Thus, as seen in FIG. 34, buttons 440 extend through registering bores 420 in inner leg 336B and one set of registering bores 410 in outer leg 336A. In this position, buttons 440 prevent any relative axial movement between outer leg 336A and inner leg 336B. When buttons 440 are pushed toward one another, as seen in FIG. 35, they no longer extend through registering bores 410. This allows adjustment of outer leg 336A in an axial direction relative to inner leg 336B. When outer leg 336A is moved to a point that a pair of bores 410 come into alignment with bores 420, biasing clip 430 will force buttons 440 to project through the bores 410 to prevent further axial movement until buttons 440 are pushed toward one another again.

In another embodiment, biasing clip 430 is of the one-sided type, having only one button 440. In such an embodiment, outer leg 336A would only need bores 410 on one side. Similarly, inner leg 336B would only have a bore 420 on the same side as bores 410. Other biasing members used to adjust the height of telescoping legs are well known to those of skill in the art and are within the scope of this invention.

In a preferred embodiment, leg portions 314 and 316 have height adjustment features. In a most preferred embodiment, all four leg portions, 314, 316, 336, and 338 have height adjustment features.

Many embodiments of hooks have been described above. It will be appreciated that depending on the need, a straight L-shaped hook (see FIG. 30) may be preferable, or a more slanted hook (see FIG. 9) may be preferable. In general though, the invention is best served by having a hook having an axial length greater than its lateral projection, e.g., a hook longer that is longer than it is wide. This allows the material to which the hook is attached to be held firmly in place between the hook and the leg of the seat assembly.

Several embodiments of the legs have been described above as well. It will be appreciated that there are various configurations and attachment means of the legs which may not be described explicitly but which are within the scope of the invention. For example, supports 312 and 334 may be different widths from one another. One of the two supports may have a bottom-cross piece while the other does not. One of the two supports may have a height adjustment feature while the other does not. The depictions in the figures provide preferred embodiments but the scope of the invention is not so limited.

While in the discussion above, and with respect to a flexible, vertical structure, only a chain link fence has been mentioned, it should be understood that other types of flexible, mesh fencing could be employed. For example chicken wire, rabbit fencing, deer fencing, sheep fencing and garden fencing are all examples of suitable "flexible" vertical structures with which the retractable seat assembly of the present invention can be used. It will be understood however that when the vertical structure is a material such as a chain link fence or the like, the strands, wires or the like forming the mesh of the fence should have sufficient strength such that they will not break too easily. In this regard it should be noted that when the retractable seat assembly of the present invention is connected to a mesh type vertical structure, once the seat is moved to the lowered position and a user sits on the seat, since the front and back support will engage the ground, floor or the like, there is little downward force exerted on the mesh of the fence. Further, when the seat is in the lowered position and is being used, there is also little outward force i.e., in the direction away from the fence or mesh. Indeed, when the seat of the retractable seat assembly is in the lowered position for use, and when a user is sitting thereon, virtually all forces acting upon the retractable seat assembly as well as the vertical structure to which the seat assembly is attached are directed downwardly through the supports to the underlying substrate e.g., the ground. Further, although mesh fencing or the like has been described as being flexible, this is by way of distinguishing such a vertical structure as a support from a wall or other rigid or solid vertical structure.

The versatility of the retractable seat assembly of the present invention enables it to be connected to a semi-flexible surface such as a chain link fence and in this regard can be easily installed and removed as described above. Further, when used in a sports venue environment e.g., a baseball/softball field, the fence surrounding a tennis court etc. since the seat assembly automatically folds to a structure substantially parallel to the chain link fence etc., once the user removes weight from the seat, the seat and the front support automatically retract to an upright position thereby posing no obstacle to a player who might have to closely approach the chain link fence or the like e.g., to retrieve a foul fly ball etc.

The retractable seat assembly of the present invention also provides a quick, efficient and unobtrusive way to provide temporary seating, if needed, in a gymnasium, auditorium or the like using the embodiments shown in FIGS. 20-25.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A retractable seat assembly for attaching to a generally vertical structure, comprising:

a frame having a front side and a back side, said frame including a support portion and a connection portion, said support portion comprising spaced apart first and second legs, said first leg comprised of first and second leg portions, said second leg comprised of third and fourth leg portions, said first and second leg portions being movable relative to one another, said third and fourth leg portions being movable relative to one another;

a seat pivotally connected to said frame at said connection portion;

a biaser operatively connected to said seat and said frame to releasably bias said seat to a generally upright position;

a front support pivotally connected to said seat distal said connection portion, wherein when said seat is in said generally upright position, said front support and said seat are in planes parallel to one another;

at least one hook disposed on each of said first and second legs for attaching said back side of said frame to said generally vertical structure.

2. The assembly of claim 1, wherein said biaser comprises at least one torsion spring.

3. The assembly of claim 1, wherein said biaser comprises a plurality of torsion springs.

4. The assembly of claim 1, wherein each of said first and second legs comprise a detent assembly for selectively preventing relative movement between said first and second leg portions and said third and fourth leg portions, respectively.

5. The assembly of claim 1, wherein said at least one hook is pivotally attached to said frame.

6. The assembly of claim 1, wherein said at least one hook is generally L-shaped.

7. The assembly of claim 1 further comprising a stop attached to said front support for limiting the pivotal movement of said front support.

8. The assembly of claim 1 further comprising at least one pivoting arm connecting said frame and said front support.

9. The assembly of claim 1, wherein said first and second legs have upper bent portions and lower bent portions wherein said upper bent portions bend said first and second legs in the direction of said front side of said frame, and said lower bent portions bend said first and second legs in the direction of said back side of said frame.

10. The assembly of claim 1, wherein said first and second legs have lower bent portions wherein said lower bent portions bend said first and second legs in the direction of said back side of said frame.

11. A retractable seat assembly for attaching to a generally vertical structure, comprising:

a frame having a front side and a back side, said frame including a support portion and a connection portion, said support portion comprising spaced apart first and second legs, said first and second legs having upper bent portions and lower bent portions, wherein said upper bent portions bend said first and second legs in the direction of said front side of said frame, and said lower bent portions bend said first and second legs in the direction of said back side of said frame;

a seat pivotally connected to said frame at said connection portion;

a biaser operatively connected to said seat and said frame to releasably bias said seat to a generally upright position;

a front support pivotally connected to said seat distal said connection portion, wherein when said seat is in said generally upright position, said front support and said seat are in planes parallel to one another;

at least one hook disposed on each of said first and second legs for attaching said back side of said frame to said generally vertical structure.

12. The assembly of claim 11, wherein said first leg comprises first and second leg portions, said second leg comprises third and fourth leg portions, said first and second leg portions being movable relative to one another, said third and fourth leg portions being movable relative to one another.

13. The assembly of claim 12, wherein each of said first and second legs comprise a detent assembly for selectively preventing relative movement between said first and second leg portions and said third and fourth leg portions, respectively.

* * * * *